US007281875B1

(12) United States Patent
Todd

(10) Patent No.: US 7,281,875 B1
(45) Date of Patent: Oct. 16, 2007

(54) CAULK APPLICATOR

(75) Inventor: Ronald Todd, Flushing, MI (US)

(73) Assignee: Elite Products, Flushing, MI (US)

( * ) Notice: Subject to any disclaimer, the term of this patent is extended or adjusted under 35 U.S.C. 154(b) by 0 days.

(21) Appl. No.: 11/657,871

(22) Filed: Jan. 25, 2007

Related U.S. Application Data

(60) Provisional application No. 60/762,679, filed on Jan. 27, 2006.

(51) Int. Cl.
*B43K 11/02* (2006.01)

(52) U.S. Cl. ..... 401/219; 401/208

(58) Field of Classification Search ..... 401/147, 401/193, 208, 219; 118/256, 258, 259, 262, 118/244; 222/173–174, 566, 567, 191, 327; 492/13, 17, 19
See application file for complete search history.

(56) References Cited

U.S. PATENT DOCUMENTS 133,163 A * 11/1872 Halsey et al. ..... 34/95.1
2,667,867 A 2/1954 Petersen
2,816,308 A * 12/1957 Schultz ..... 401/193
3,027,591 A 4/1962 Petersen
3,028,868 A 4/1962 Tandler, Jr.
3,441,355 A 4/1969 Brown
4,150,904 A 4/1979 Stewart
4,167,349 A * 9/1979 Testa ..... 401/144
5,302,043 A 4/1994 Velliquette
5,934,816 A 8/1999 Bruttomesso
6,045,283 A 4/2000 Velasquez et al.
6,123,478 A 9/2000 Giles
6,190,077 B1 2/2001 Newson et al.
6,386,782 B1 5/2002 White, Sr.
6,394,681 B1 5/2002 Moore
6,705,791 B2 3/2004 Harper
2004/0197130 A1 10/2004 Major et al.

* cited by examiner

*Primary Examiner*—Huyen Le
(74) *Attorney, Agent, or Firm*—Young Basile

(57) ABSTRACT

A caulk applicator attachable to a caulk delivery apparatus. The caulk applicator comprises an applicator body having a retainer bracket and a scraper element, wherein the retainer bracket is attachable to the caulk delivery apparatus. An applicator wheel is rotatably mounted to the applicator body and has a fluid application surface, wherein the fluid application surface is engageable with the scraper element.

16 Claims, 2 Drawing Sheets

CAULK APPLICATOR

CROSS REFERENCE TO RELATED APPLICATIONS

This application claims the benefit of U.S. Provisional Application No. 60/762,679, filed Jan. 27, 2006.

FIELD OF THE INVENTION

The present invention relates to the field of fluid applicators, and more particularly, the present invention relates to a caulk applicator having a rotatable applicator wheel upon which a bead of caulking material may be received from a caulk delivery apparatus.

BACKGROUND OF THE INVENTION

A number of apparatuses have been employed to apply a thin bead of viscous sealing material to a surface. Particularly, many of these apparatuses are well-suited to apply a bead of joint compound or caulking compound to a joint or crack.

Once well-known method for filling a joint or crack with caulking compound employs a caulk delivery apparatus, or caulk gun, having an operating mechanism that controls the flow of caulking compound from the nozzle portion of a replaceable caulking compound container. However, when such an apparatus is used to apply caulking compound to an overhead surface, the caulking compound may fall away from the ceiling before it adheres to the joint or crack. Furthermore, normal methods of finishing caulk joints are time-consuming and cumbersome when the work area is overhead. Thus, such an apparatus is ill-suited for filling a gap or crack in a ceiling surface.

For this reason, joints or cracks in ceilings are typically finished or repaired by first applying joint tape to the crack and then blending the joint tape into the ceiling by applying joint compound using a putty knife to transfer the joint compound to the ceiling from a bucket or pan. Such an arrangement typically requires use of a ladder to allow the drywall installer to reach the portion of the ceiling being caulked. Thus, the drywall installer is limited to working on a small segment of the ceiling before the ladder must be moved, creating an undesirable inefficiency. Furthermore, when repairing an acoustic ceiling, sometimes referred to as a "popcorn ceiling," the acoustic material must first be removed in the area of the joint or crack and subsequently replaced.

It would be desirable to have a caulk applicator that is attachable to a caulk delivery apparatus to apply a thin bead of caulking compound to a crack or joint in a ceiling. It would further be desirable to have a caulk applicator that may repair a crack or joint in an acoustic ceiling without removing the acoustic material.

SUMMARY OF THE INVENTION

The present invention is a caulk applicator that is attachable to a caulk delivery apparatus. The caulk applicator comprises an applicator body and an applicator wheel rotatably mounted to the applicator body. The applicator body has a retainer bracket and a scraper element, wherein the retainer bracket is attachable to the caulk delivery apparatus. The applicator wheel has a fluid application surface, wherein the fluid application surface is engageable with the scraper element. Moreover, the scraper element and the fluid application surface of the applicator wheel may have complementary shapes.

The applicator body further includes a tubular collar connected to the retainer bracket, wherein at least a portion of the caulk delivery apparatus extends through the tubular collar. Moreover, a first arm portion may be included to connect the tubular collar to the scraper element, wherein the first arm portion spaces the tubular collar from the scraper element. The applicator body may further include an axle, wherein the applicator wheel is rotatably disposed upon the axle, and a second arm portion connecting the scraper element to the axle, wherein the second arm portion spaces the scraper element from the axle. Additionally, the applicator body may include a flange connected to the scraper element, wherein the scraper element is operative to remove a bead of caulking compound from the fluid application surface of the applicator wheel, and the flange is operative to receive the bead of caulking compound thereon.

BRIEF DESCRIPTION OF THE DRAWINGS

The various other uses of the present invention will become more apparent by referring to the following detailed descriptions and drawings in which.

DETAILED DESCRIPTION OF THE INVENTION

Figure 1:
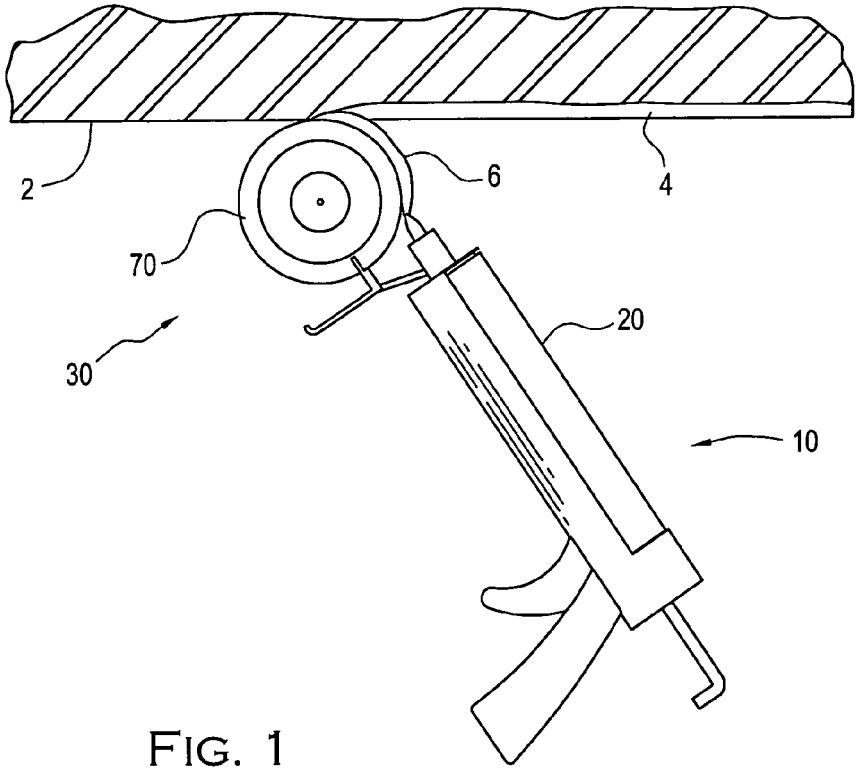
FIG. 1 is an illustration of caulking compound being applied to a joint or crack in a ceiling surface by the caulk applicator of the present invention.
Figure 2:
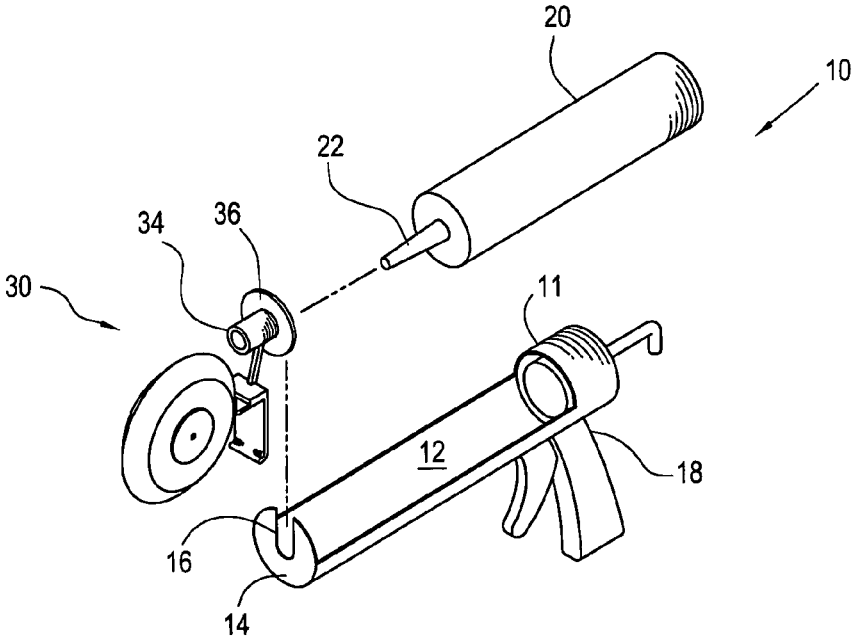
FIG. 2 is an assembly view of a caulk delivery apparatus in combination with the caulk applicator of the present invention.

FIG. 1 shows a caulk applicator 30 of the present invention applying a caulking compound 6 to a crack 4 in a work surface, such as a ceiling surface 2. The caulk applicator 30 may be used with all manner of ceiling surfaces 2, including an acoustic ceiling surface, that is, a drywall ceiling surface having a sprayed-on acoustic coating. The caulk applicator 30 is attachable to a caulk delivery apparatus 10. As shown in FIG. 2, the caulk applicator 30 includes a caulk applicator wheel 70 and an applicator body 32. The caulk applicator wheel 70 has a fluid application surface 72 upon which a thin bead of caulking compound 6 may be supplied by the caulk delivery apparatus 10. The applicator body 32 includes a scraper portion 40 that is engageable with the fluid application surface 72 of the applicator wheel 70 and a retainer bracket 36 that permits the caulk applicator 30 to be securely attached to the caulk delivery apparatus 10.

The caulk applicator 30 of the present invention is intended to be used with a means for supplying caulk, such as the caulk delivery apparatus 10. The caulk delivery apparatus 10 is well-known in the art and includes a body portion 11 having a chamber 12 in which a standard caulking compound container 20 is removably disposed, as shown in FIG. 2. The caulking compound container 20 includes a nozzle 22 that extends through a slot 16 formed in an end wall 14 of the chamber 12 of the body portion 11 when the caulking compound container 20 is disposed within the chamber 12 of the body 11 of the caulk delivery apparatus 10. The body portion 11 of the caulk delivery apparatus 10 further includes an operating mechanism 18 which may be any of several well-known structures that serve to engage the caulking compound container 20 to thereby expel a thin bead of caulking compound 6 from the nozzle 22 of the caulking compound container 20.

Figure 3:
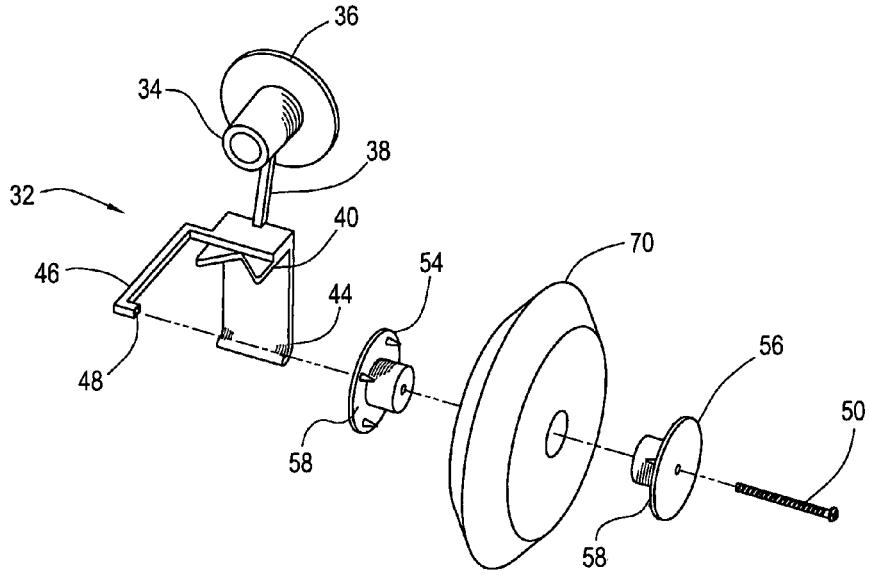
FIG. 3 is an exploded view of the caulk applicator of the present invention.

As shown in FIG. 3, the applicator body 32 of the caulk applicator 30 includes a plurality of sub-portions that may be formed integrally or may be connected to one another by any conventional means. The applicator body 32 includes a collar portion 34 and associated retainer bracket 36 that are attachable to the caulk delivery apparatus 10. Specifically, the collar portion 34 is a substantially cylindrical, hollow, tube-like structure through which the nozzle 22 of the caulking compound container 20 may be inserted. When the caulk applicator 30 is attached to the caulk delivery apparatus 10, the collar portion 34 extends through the slot 16 in the end wall 14 of the chamber 12 of the caulk delivery apparatus 10. The retainer bracket 36 is a thin, disc-like structure that extends annularly from the outer periphery of one end of the collar portion 34 of the applicator body 32. The retainer bracket 36 allows attachment of the applicator body 32 to the caulk delivery apparatus 10, as the retainer bracket 36 may be clamped between the end wall 14 of the caulk delivery apparatus 10 and the caulking compound container 20.

In order to prevent buildup of excess caulking compound 6 upon the applicator wheel 70, the applicator body 32 includes a scraper portion 40. The scraper portion 40 is connected to the collar portion 34 by a first arm portion 38. Caulking compound 6 that is removed from the applicator wheel 70 by the scraper portion 40 may be deposited and retained upon a flange 44. The flange 44 is located adjacent to the scraper portion 40 and may include a curved or bent surface to promote retention of caulking compound 6 upon the flange 44.

In order to attach the applicator body 32 to the applicator wheel 70, the applicator body 32 includes an axle receiver 48 in which an axle 50 may be received. The axle receiver 48 is connected to the scraper portion 40 by a second arm portion 46 that extends radially from the axle receiver 50 to the scraper portion 40.

The caulking compound 6 is applied to the ceiling surface 2 by the applicator wheel 70. The applicator wheel 70 may be formed from a number of materials, including, but not limited to, textiles and plastics, especially open-cell polyurethane foam plastic. The applicator wheel 70 may be shaped as a cylinder having a beveled outer surface or fluid application surface 72. Furthermore, a hollow, substantially cylindrical bore 84 may extend between the first side surface 80 and the second side surface 82 of the applicator wheel 70.

The fluid application surface 72 of the applicator wheel 70 includes a first beveled surface 76 and a second beveled surface 78. The first beveled surface 76 extends from a first side surface 80 of the applicator wheel 70 to an outer periphery 74 of the applicator wheel 70. Likewise, the second beveled surface 78 extends from a second side surface 82 and the outer periphery 74 of the applicator wheel 70. However, it should be noted that the fluid application surface 72 is not limited to a first beveled surface 76 and a second beveled surface 78, but rather, the fluid application surface 76 may include any number of discrete surfaces operative to receive caulking compound 6, either alone or in cooperation with one another.

Figure 4:
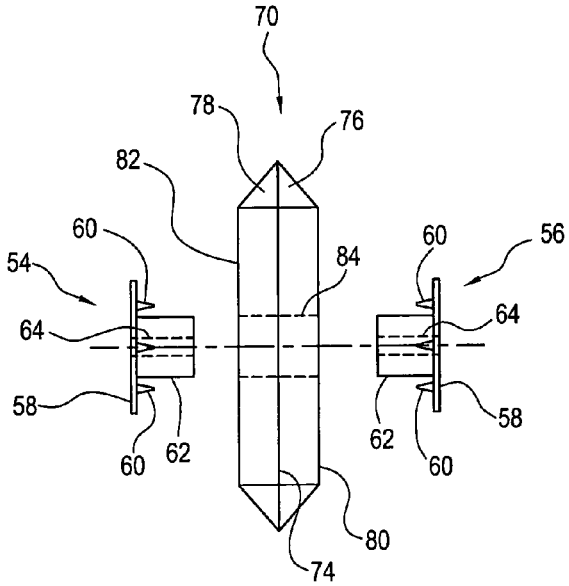
FIG. 4 is an exploded detail view of the two-part carrier and applicator wheel of the caulk applicator of the present invention.

In order to permit smooth rotation of the applicator wheel 70 upon the axle 50, the applicator wheel 70 is seated upon a carrier such as a two-part carrier having a first carrier half 54 and a second carrier half 56, as shown in FIG. 4. The first and second carrier halves 54, 56 are substantially identical, each having a radial surface 62 engageable with the bore 84 of the applicator wheel 70, and a throughbore 64 in which the axle 50 may be received. Each of the first and second carrier halves 54, 56 includes an end wall 58 that is engageable with the first and second side surfaces 80, 82 of the applicator wheel 70 to thereby retain the applicator wheel 70 between the first and second carrier halves 54, 56. So that the first and second carrier halves 54, 56 turn in unison with the applicator wheel 70, pins 60 extend inwardly from the end walls 58 of each of the first and second carrier halves 54, 56. The pins 60 may puncture the applicator wheel 70 to thereby lock the applicator wheel 70 in synchronized rotation with the first and second carrier halves 54, 56.

Figure 5:
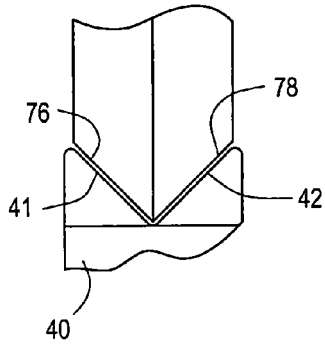
FIG. 5 is a detail view of the scraper element of the caulk applicator of the present invention.

When the applicator wheel 70 is seated upon the first and second carrier halves 54, 56, and the axle 50 is secured with respect to the axle receiver 48 to thereby connect the applicator wheel 70 to the applicator body 32, the applicator wheel 70 may rotate freely with respect to the applicator body 32. The applicator body 32 and the applicator wheel 70 are sized such that the fluid application wheel 72 may engage the scraper portion 40 without substantially impeding free rotation of the applicator wheel 70 about the axle 50. As shown in FIG. 5, the scraper portion 40 is complementary to the shape of the applicator wheel 70, including a first scraping surface 41 configured to engage the first beveled surface 76 of the applicator wheel 70, and a second scraping surface 42 of the scraper portion 40 configured to engage the second beveled surface 78 of the applicator wheel 70.

In use, the caulk applicator 30 is first attached to a caulk delivery apparatus 10. This is accomplished by first seating the collared portion 34 over the nozzle 22 of the caulking compound container 20 such that the retainer bracket 36 of the collared portion 34 engages the caulking compound container 20. Next, the caulking compound container 20 is placed into the chamber 12 of the caulk delivery apparatus 10 such that the retainer bracket 36 of the caulk applicator 30 is held between the end wall 14 of the caulk delivery apparatus and the caulking compound container 20. So situated, the collar portion 34 of the caulk applicator 30 and the nozzle 22 of the caulking compound container 20 extend through the slot 16 and the end wall 14 of the caulk delivery apparatus 10. The user of the caulk applicator 30 is now free to employ the operating mechanism 18 of the caulk delivery apparatus 10 to control the flow of caulking compound 6 from the nozzle 22 of the caulking compound container 20. Since the nozzle 22 of the caulking compound container 20 is now located adjacent to the fluid application surface 72 of the applicator wheel 70, caulking compound 6 that is dispensed from the nozzle 22 of the caulking compound container 20 is applied to the fluid application surface 72 of the applicator wheel 70. Thus, the user of the caulk applicator 30 may now position the applicator wheel 70 near a crack 4 on a ceiling surface 2 to thereby apply caulking compound 6 to the crack.

Before caulking compound 6 is applied to the crack 4, the ceiling surface 2 is prepared as necessary. However, it is noted that if the ceiling surface 2 has an acoustic coating, the crack 4 may be filed without removing the acoustic coating.

The user begins filling the crack 4 in the ceiling surface by engaging the operating mechanism 18 of the caulk delivery apparatus to supply caulking compound 6 to the applicator wheel 70 while rolling the applicator wheel 70 along the ceiling surface 2. In this manner, the fluid application surface 72 of the applicator wheel 70 travels past the scraper portion 40 where excess caulking compound 6 is removed from the fluid application surface 72, before traveling onward to the area of the nozzle 22 of the caulking compound container 20. A thin bead of caulking compound 6 is then deposited upon the fluid application surface 72 of the applicator wheel 70. Subsequent rotation of the applicator wheel 70 with respect to the ceiling surface 2 delivers the caulking compound 6 to the crack 4. Further engagement of the applicator wheel 70 to the ceiling surface 2 presses the bead of caulking compound 6 into the crack 4 and leaves a substantially smooth, finished surface upon the ceiling surface 2.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is performed under the law.

What is claimed is:

1. A caulk applicator, comprising:

a caulk delivery body having a chamber formed therein, said chamber having an end wall, and said end wall having a slot formed therein;

a caulking compound container having a nozzle extending therefrom, wherein said caulking compound container is disposed within said chamber and said nozzle extends through said slot;

an applicator body having a retainer bracket and a scraper element, wherein said retainer bracket is disposed within said chamber between said end wall and said caulking compound container and said nozzle extends through said retainer bracket; and an applicator wheel rotatably mounted to said applicator body, and said applicator wheel having a fluid application surface, wherein said fluid application surface is engageable with said scraper element.

2. The caulk applicator stated in claim 1, wherein said scraper element and said fluid application surface of said applicator wheel have complementary shapes.

3. The caulk applicator stated in claim 1, said applicator body further comprising:

a tubular collar connected to said retainer bracket, wherein said tubular collar extends through said slot and said nozzle extends through said tubular collar.

4. The caulk applicator stated in claim 3, said applicator body further comprising:

a first arm portion connecting said tubular collar to said scraper element, wherein said first arm portion spaces said tubular collar from said scraper element.

5. The caulk applicator stated in claim 4, said applicator body further comprising:

an axle, wherein said applicator wheel is rotatably disposed upon said axle; and a second arm portion connecting said scraper element to said axle, wherein said second arm portion spaces said scraper element from said axle.

6. The caulk applicator stated in claim 5, said applicator body further comprising:

a flange connected to said scraper element, wherein said scraper element is operative to remove a bead of caulking compound from said fluid application surface of said applicator wheel and said flange is operative to receive the bead of caulking compound thereon.

7. The caulk applicator stated in claim 1, the applicator body further comprising:

a flange connected to said scraper element, wherein said scraper element is operative to remove a caulking compound from said fluid application surface of said applicator wheel and said flange is operative to receive the caulking compound thereon.

8. A caulk applicator attachable to a caulk delivery apparatus having a body portion having a chamber formed therein and a caulking compound container disposed within the chamber and having a nozzle extending therefrom, the caulk applicator comprising:

an applicator body having a retainer bracket and a substantially tubular collar portion connected to said retainer bracket, wherein said retainer bracket is disposable between the body portion of the caulk delivery apparatus and the caulking compound container of the caulk delivery apparatus to secure said applicator body to the caulk delivery apparatus, and wherein the nozzle of the caulking compound container is extendable through said substantially tubular collar; and an applicator wheel rotatably mounted to said applicator body, and said applicator wheel having a fluid application surface, wherein the nozzle of the caulking compound container is operative to disburse a bead of caulk upon said fluid application surface.

9. The caulk applicator stated in claim 8, said applicator body further comprising:

a scraper element, wherein said fluid application surface of said applicator wheel is engageable with said scraper element.

10. A caulk applicator, comprising:

an applicator body having a retainer bracket and a substantially tubular collar portion connected to said retainer bracket, wherein said retainer bracket is disposable between the body portion of the caulk delivery apparatus and the caulking compound container of the caulk delivery apparatus, and wherein the nozzle of the caulking compound container is receivable within said substantially tubular collar;

an applicator wheel rotatable mounted to said applicator body, and said applicator wheel having a fluid application surface, wherein the nozzle of the caulking compound container is operative to disburse a bead of caulk upon said fluid application surface;

a scraper element, wherein said fluid application surface of said applicator wheel is engageable with said scraper element; and a first arm portion connecting said tubular collar to said scraper element, wherein said first arm portion spaces said tubular collar from said scraper element.

11. The caulk applicator stated in claim 10, said applicator body further comprising:

an axle, wherein said applicator wheel is rotatably disposed upon said axle; and a second arm portion connecting said scraper element to said axle, wherein said second arm portion spaces said scraper element from said axle.

12. The caulk applicator stated in claim 11, said applicator body further comprising:

a flange connected to said scraper element, wherein said scraper element is operative to remove the bead of caulking compound from said fluid application surface of said applicator wheel and said flange is operative to receive the bead of caulking compound thereon.

13. A caulk applicator, comprising:

a caulking compound container having a nozzle extending therefrom;

a chamber having an end wall with a slot formed therein, wherein said caulking compound container is disposed within said chamber such that said nozzle extends through said slot;

a retainer bracket disposed between said caulking compound container and said end wall;

a collar connected to said retainer bracket and said collar extending through said slot in said end wall;

a first arm portion connected to said collar;

a scraper element connected to said first arm portion, wherein said first arm portion spaces said scraper element with respect to said collar;

a second arm portion connected to said scraper element;

an axle connected to said second arm portion, wherein said second arm portion spaces said axle from said scraper element; and an applicator wheel rotatably mounted on said axle, and said applicator wheel having a fluid application surface, wherein said fluid application surface is engageable with said scraper element.

14. The caulk applicator stated in claim 13, wherein said scraper element and said fluid application surface of said applicator wheel have complementary shapes.

15. The caulk applicator stated in claim 13, further comprising:

a first carrier half and a second carrier half, wherein said first and second carrier halves are disposed on opposite sides of said applicator wheel and said axle extends through said carrier halves for rotatably mounting said applicator wheel to said second arm portion.

16. The caulk applicator stated in claim 13, further comprising:

a flange connected to said scraper element, wherein said scraper element is operative to remove a bead of caulking compound from said fluid application surface of said applicator wheel and said flange is operative to receive the bead of caulking compound thereon.

* * * * *